US007614855B2

(12) United States Patent
Cook

(10) Patent No.: US 7,614,855 B2
(45) Date of Patent: Nov. 10, 2009

(54) PUMP AND MOTOR ASSEMBLY

(75) Inventor: James E. Cook, Anoka, MN (US)

(73) Assignee: Arimitsu of North America, Inc., Anoka, MN (US)

( * ) Notice: Subject to any disclaimer, the term of this patent is extended or adjusted under 35 U.S.C. 154(b) by 390 days.

(21) Appl. No.: 10/907,430

(22) Filed: Mar. 31, 2005

(65) Prior Publication Data

US 2006/0228232 A1 Oct. 12, 2006

(51) Int. Cl.
*F04B 35/00* (2006.01)
*F01B 23/08* (2006.01)

(52) U.S. Cl. ..... 417/363; 417/359; 417/360; 417/321; 417/572; 264/674; 464/106

(58) Field of Classification Search ..... 417/321, 417/359, 360, 363, 572; 248/674; 464/106
See application file for complete search history.

(56) References Cited

U.S. PATENT DOCUMENTS 2,739,537 A * 3/1956 Sadler et. al. ..... 417/360
3,994,624 A * 11/1976 Plunkett et al. ..... 417/38
4,200,426 A 4/1980 Linnert
4,211,519 A * 7/1980 Hogan ..... 417/360
4,601,378 A * 7/1986 Pierce et al. ..... 192/115
4,725,205 A * 2/1988 Cannon et al. ..... 417/363
4,762,281 A 8/1988 Eberhardt
4,850,812 A 7/1989 Voight
4,900,224 A * 2/1990 Timperi et al. ..... 415/213.1
4,911,609 A * 3/1990 Anderson et al. ..... 415/174.2
4,988,069 A * 1/1991 D'Silva ..... 248/605
5,007,806 A * 4/1991 Bellis et al. ..... 417/360
5,184,941 A 2/1993 King et al.
5,221,192 A 6/1993 Heflin et al.
5,354,182 A 10/1994 Niemiec et al.
5,531,573 A * 7/1996 Nokubo ..... 417/360
5,823,752 A * 10/1998 Hoenisch et al. ..... 417/363

(Continued)

OTHER PUBLICATIONS

Bushing, http://en.wikipedia.org/w/index.php?title=Bushing&oldid=258602431 (last visited Dec. 25, 2008).*

(Continued)

*Primary Examiner*—Devon C Kramer
*Assistant Examiner*—Leonard J Weinstein
(74) *Attorney, Agent, or Firm*—Crompton Seager & Tufte, LLC

(57) ABSTRACT

A fluid pumping system that includes a motor and a pump, wherein an output shaft of the motor is directly coupled to an input shaft of the pump. This coupling between the output shaft of the motor and the input shaft of the pump may be the primary mechanism for coupling the motor to the pump. Such a configuration may be called a "floating pump mount", because the pump is primarily coupled to the motor via the shaft connection. As a result of this connection, the output shaft of the motor may be naturally "aligned" with the input shaft of the pump. To help prevent the pump from freely rotating with the output shaft of the motor during operation, a rotational stop mechanism may be provided. The rotational stop mechanism may include at least one resilient member for absorbing or substantially absorbing at least some of any relative movement between the pump and the motor.

19 Claims, 12 Drawing Sheets

U.S. PATENT DOCUMENTS

| | | | | |
|---|---|---|---|---|
| 5,908,183 | A * | 6/1999 | Fury | 248/274.1 |
| 5,975,863 | A | 11/1999 | Mazzucato | |
| 6,034,465 | A | 3/2000 | McKee et al. | |
| 6,279,866 | B1 * | 8/2001 | Eilemann et al. | 248/638 |
| 6,336,794 | B1 | 1/2002 | Kim | |
| 6,378,832 | B1 * | 4/2002 | Li et al. | 248/637 |
| 6,439,860 | B1 * | 8/2002 | Greer | 417/360 |
| 6,491,494 | B1 | 12/2002 | Beckenbach et al. | |
| 6,932,439 | B2 * | 8/2005 | Nakazawa | 303/116.4 |
| 2003/0103850 | A1 | 6/2003 | Szulczewski | |
| 2003/0160525 | A1 | 8/2003 | Kimberlin et al. | |
| 2004/0033144 | A1 | 2/2004 | Rush | |
| 2004/0175278 | A1 | 9/2004 | Dexter et al. | |

OTHER PUBLICATIONS

"Bushing." The American Heritage® Dictionary of the English Language, Fourth Edition. Houghton Mifflin Company, 2004. Dec. 25, 2008. <Dictionary.com http://dictionary.reference.com/browse/bushing>.*

Coupling, http://en.wikipedia.org/w/index.php?title=Coupling&oldid=246987798 (last visited Dec. 25, 2008).*

"Coupling." Webster's Revised Unabridged Dictionary. MICRA, Inc. Dec. 25, 2008. <Dictionary.com http://dictionary. reference.com/browse/coupling>.*

"Car Wash Products," Cat Pumps, 4 pages, prior to filing date of present application.

"Hypro Pumps, Pressure Washer Master Catalog," Hypro Corporation, 22 pages, prior to filing date of present application.

Brochure, "Vision, Innovation, Strategy, Execution," Inventors' Publishing & Research, 6 pages, prior to filing date of present application.

Catalog, "Pumps and Pump Mounting Accessories," 12 pages, prior to filing date of present application.

* cited by examiner

PUMP AND MOTOR ASSEMBLY

FIELD

The present invention generally relates to the field of pumps, and more particularly, to pumps that are driven by a motor such as an internal combustion engine, a hydraulic motor or an electric motor.

BACKGROUND

Fluid pumping systems are currently used in a wide variety of applications. In some cases, the fluid pumping systems include a pump head that is driven by a rotary motor, such as an internal combustion engine, a hydraulic motor or an electric motor. When driven by the motor, the pump head often produces a pressurized fluid stream that can be used in any number of applications. One illustrative application is that of a high pressure washing device. High pressure washing devices typically deliver a fluid such as water under relatively high pressure to a surface to be cleaned, stripped or prepared for other treatment. Such pressure washers are produced in a variety of designs and can be used to perform numerous functions in industrial, commercial and home applications.

Fluid pumping systems can be either stationary or portable. Stationary fluid pumping systems are generally used in industrial or commercial applications such as in car washes, manufacturing facilities, or the like. Portable fluid pumping systems may include a motor/pump unit that can be carried or wheeled from place to place.

In some cases, fluid pumping systems use a piston pump having one or more reciprocating pistons for delivering liquid under pressure to the pump outlet. Such piston pumps often have two or more pistons to provide a generally more continuous pressure, higher flow rate, and greater efficiency. Multiple piston pumps often use articulated pistons, or may use a swash plate and linear pistons for pumping the liquid. Other pump designs may also exist.

In many cases, power from the motor is transferred to the rotating input shaft of the pump via one or more belts, gears, or the like. However, the use of belts, gears or the like can consume significant energy, thereby reducing the power that is actually delivered and available to the pump. Thus, to achieve a desired pumping capacity, the motor may have to be driven harder, or a larger motor may have to be provided. This can increase the cost of operating the fluid pumping system. In addition, the use of belts, gears or the like can require significant maintenance, which may also increase the cost of operating the fluid pumping system.

One approach to overcome some of these limitations is to drive the rotating input shaft of the pump directly from the rotating drive shaft of the motor. In some cases, both the motor and the pump are attached to a common substrate with the rotating drive shaft of the motor connected directly to the rotating input shaft of the pump. However, in such systems, the mechanical alignment of the shafts, and the ease with which such alignment may be obtained, are of particular concern. The driving and driven shafts may be said to be perfectly aligned when their axes of rotation are coincident with one another at all times. Such perfect alignment would be ideal, but it is often difficult to achieve. In addition, such shaft misalignments can be static and/or transient. As a practical matter, it is not very economical to hold machining tolerances so closely that shaft misalignments are not of a concern. Shaft misalignment can increase vibration, consume energy, degrade motor and/or pump performance, increase operating noise, accelerate wear and tear as well as have other detrimental effects.

SUMMARY

The present invention provides a fluid pumping system or assembly that includes a motor and a pump. An output shaft of the motor is directly coupled to an input shaft of the pump. In one illustrative embodiment, the output shaft of the motor is directly coupled to the input shaft of the pump in such a way that prevents the pump and the motor from moving away from each other during operation, and in some cases, is the primary mechanism for coupling the pump to the motor. Such a configuration may be called a "floating pump mount", because the pump is primarily coupled to the motor via the shaft connection. As a result of this connection, the output shaft of the motor may be naturally "aligned" with the input shaft of the pump. There may be some relative movement between the pump and motor housings caused by shaft irregularities, but this relatively movement does not produce the same detrimental effects as a shaft misalignment.

To help prevent the pump from freely rotating with the output shaft of the motor during operation, a rotational stop mechanism may be provided. In addition to preventing the pump from freely rotating with the output shaft of the motor, the rotational stop mechanism may provide at least one resilient member for absorbing or substantially absorbing at least some of the relative movement between the pump and the motor. In some illustrative embodiments, the rotational stop mechanism may include a bracket that is coupled between the pump and the motor housings. The at least one resilient member may be situated between the bracket and the motor and/or the bracket and the pump. In some embodiments, the bracket may be adapted to not significantly prevent the pump and motor from moving away from each other during operation. Instead, and as noted above, the coupling between the pump input shaft and the motor output shaft may provide the primary mechanism for preventing the pump and motor from moving away from each other during operation. Such a configuration may help keep the output shaft of the motor naturally "aligned" with the input shaft of the pump, while allowing some movement between the motor and pump housings while at the same time preventing the pump from freely rotating with the output shaft of the motor during operation.

To help reduce the downward torque on the drive shaft of the motor caused by the weight of the pump, it may be beneficial to reduce the distance that the pump is spaced from the motor. In some embodiments, the motor may have a rotating output shaft with an output shaft bearing, and the pump may have a rotating input shaft with an input shaft bearing. As noted above, the input shaft of the pump may be directly coupled to the output shaft of the motor so that the input shaft of the pump and the output shaft of the motor are fixed relatively to one another to prevent the pump and the motor from moving away from each other during operation. To reduce the downward torque on the motor drive shaft, the spacing between the output shaft bearing of the motor and the input shaft bearing of the pump may be, for example, less than 2.0 inches, less than 1.0 inches, or less than 0.5 inches.

To help set or release the coupling, some embodiments may include a set screw in the space between the bearings. The set screw may be used to loosen and/or tighten the coupling between the input shaft of the pump and the output shaft of the motor. For example, to remove the pump from the motor, the set screw may be loosened to loosen the coupling between the output shaft of the motor and the input shaft of the pump. The pump may then be pulled away from the motor until the input shaft of the pump is disengaged from the output shaft of the motor. When a bracket is provided, the pump may be pulled sufficiently far away from the motor so that the bracket also no longer provides any anti-rotational coupling between the pump and the motor. In some cases, a safety pin may be provided, which once removed, may allow the pump to be pulled sufficiently far away so that the bracket no longer provides any coupling between the pump and the motor.

The above summary is not intended to describe each disclosed embodiment or every implementation of the present invention. The Figures and the detailed description which follow more particularly exemplify illustrative embodiments.

DETAILED DESCRIPTION

The following detailed description should be read with reference to the drawings. The drawings, which are not necessarily to scale, depict illustrative embodiments and are not intended to limit the scope of the invention.

Figure 1:
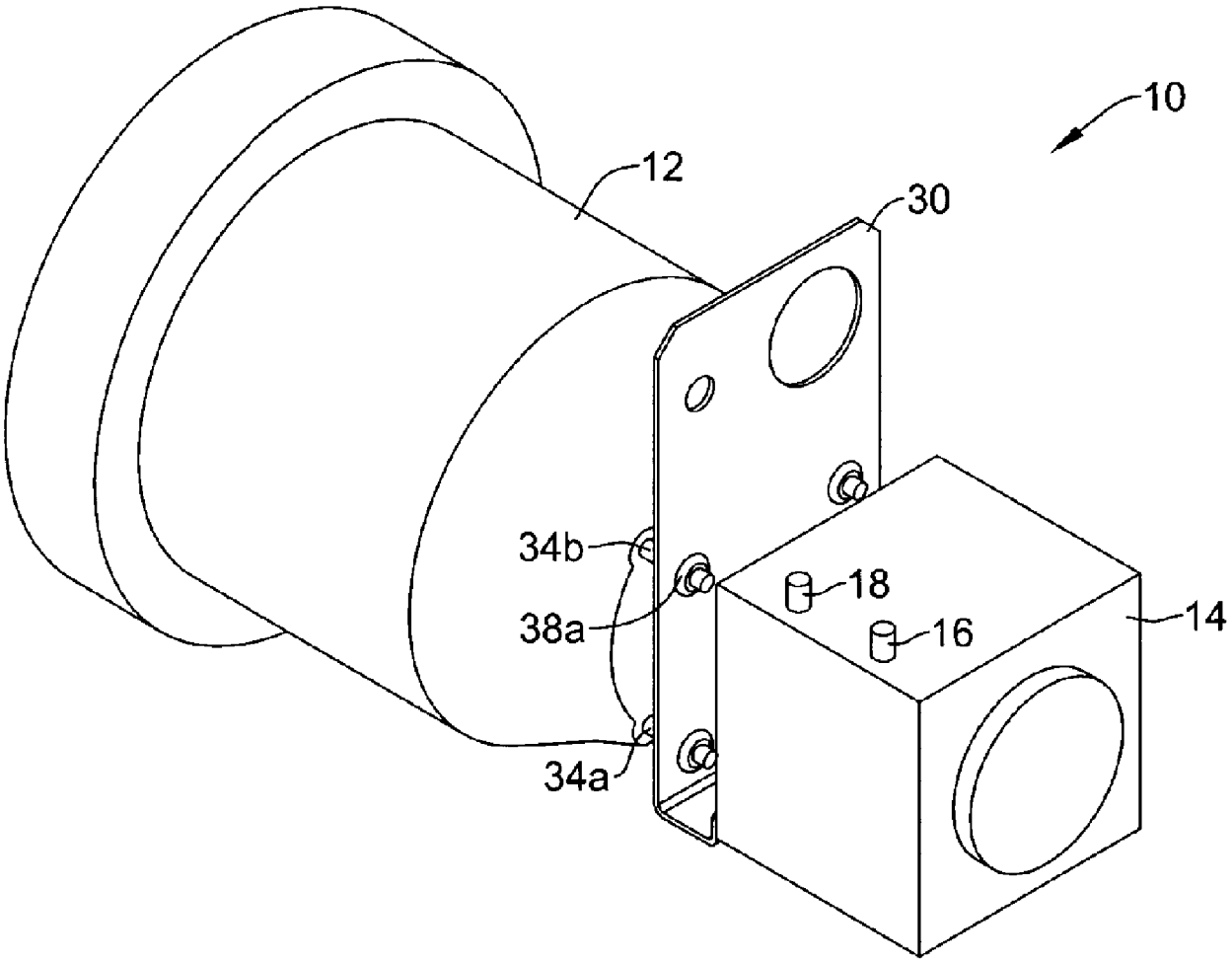
FIG. 1 is a schematic perspective view of a pump assembly in accordance with an illustrative embodiment of the present invention.
Figure 2:
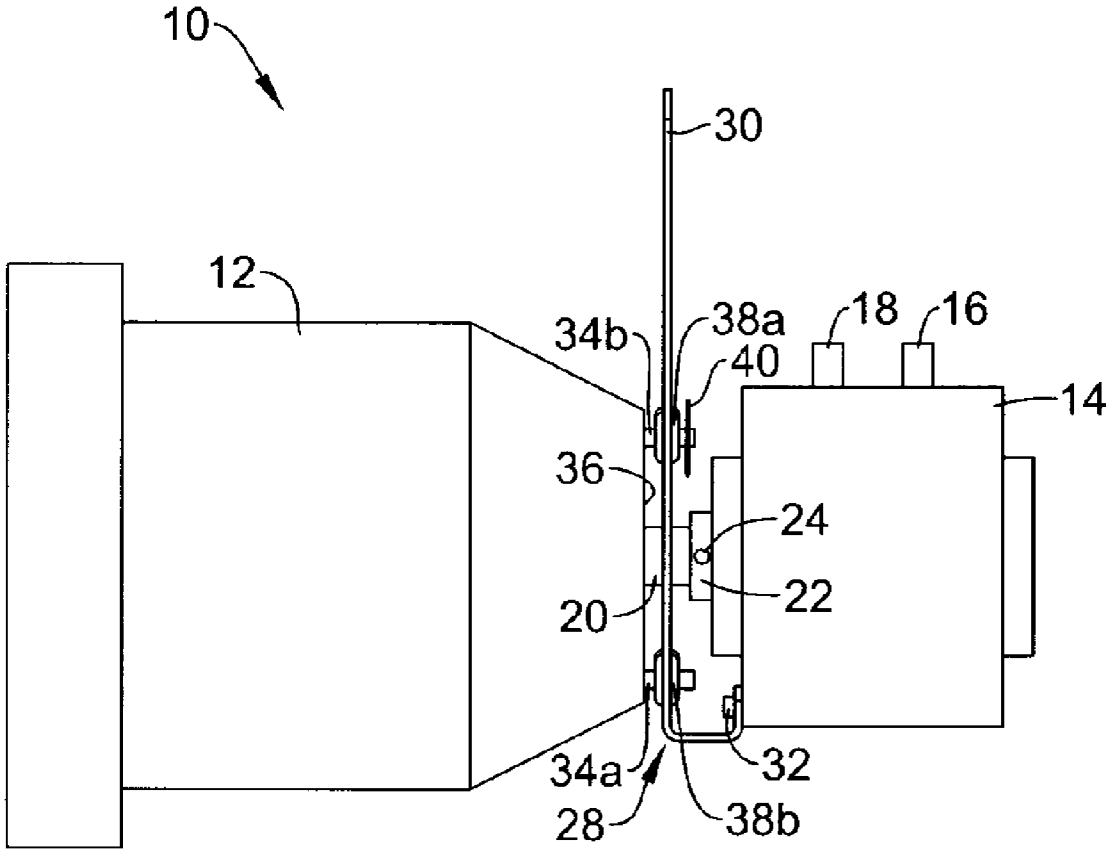
FIG. 2 is a side view of the illustrative pump assembly of FIG. 1.

FIG. 1 is a schematic perspective view of a pump assembly in accordance with an illustrative embodiment of the present invention. FIG. 2 is a side view of the illustrative pump assembly of FIG. 1. The illustrative pump assembly is generally shown at 10, and includes a motor 12 and a pump 14. The motor 12 may be any type of motor that includes a rotating output shaft 20 including, for example, an internal combustion engine, a hydraulic motor or an electric motor. The pump 14 may be any type of pump that includes a rotating input shaft 22. The illustrative pump 14 has a pump inlet 16 and a pump output 18.

As best shown in FIG. 2, the output shaft 20 of the motor 12 is directly coupled to the input shaft 22 of the pump 14. In some illustrative embodiments, the input shaft 22 of the pump 14 may have a hollow shaft end portion that has an output shaft receiving lumen for receiving the output shaft 20 of the motor 12. The input shaft 22 of the pump 14 may also have a key slot (not shown) that extends along at least part of the output shaft receiving lumen, and the output shaft 20 of the motor 12 may have a mating key member (not shown). Alternatively, or in addition, the input shaft 22 of the pump 14 may have a key member (not shown) along at least part of the output shaft receiving lumen, and the output shaft 20 of the motor 12 may have a mating key slot.

To help set or release the coupling between the input shaft 22 of the pump 14 and the output shaft 20 of the motor 12, and in some embodiments, a set screw 24 may extend through a side wall of the input shaft 22 and into the output shaft receiving lumen. The set screw 24 may engage the output shaft 20 of the motor 12, and when tightened, may secure the connection so that pump 14 is prevented from moving away from the motor 12, and visa-versa, during operation. Such a configuration may be called a "floating pump mount", because the pump 14 is primarily coupled to the motor 12 via the shaft connection. As a result of this connection, the output shaft 20 of the motor 12 may be naturally "aligned" with the input shaft 22 of the pump 14. There may be some relative movement between the pump 14 and motor 12 housings caused by shaft irregularities, but this relatively movement does not produce the same detrimental effects as a shaft misalignment.

To help prevent the pump 14 from freely rotating with the output shaft 20 of the motor 12 during operation, a rotational stop mechanism may be provided. One illustrative rotational stop mechanism is generally shown at 28, and includes a bracket 30 that is coupled between the pump 14 and the motor 12 housings. The bracket 30 is shown bolted or otherwise secured to the housing of the pump 14, such as by bolt 32. The motor 12 includes a number of shafts or studs 34*a*-34*b* extending out from the motor face 38, and the bracket 30 includes a number of corresponding holes 36 (see FIG. 3) for receiving the studs 34*a*-34*b*. The holes 36 may be sized sufficiently large so that a grommet 38 or other resilient member may be placed in the hole and between the studs 34*a*-34*b* and the bracket 30. Thus, in addition to preventing the pump 14 from freely rotating with the output shaft 20 of the motor 12, the bracket 30 and accompanying holes and grommets 38, may absorb or substantially absorb at least some of the relative movement between the pump 14 and the motor 12. In this illustrative embodiment, the bracket 30 and grommets 38 merely slide over the studs 34*a*-34*b*, and therefore do not significantly prevent the pump 14 and motor 12 from moving away from each other during operation. Instead, and as noted above, the connection between the pump input shaft 22 and the motor output shaft 20 may provide the primary mechanism for preventing the pump 14 and motor 12 from moving away from each other during operation. It is believed that such a configuration may help keep the output shaft 20 of the motor 12 naturally "aligned" with the input shaft 22 of the pump 14, while allowing some movement between the motor 12 and pump 14 housings while at the same time preventing the pump 14 from freely rotating with the output shaft 20 of the motor during operation.

In some cases, the pump 14 may present a lateral torque on the bracket 30 because more of the weight of the pump may be laterally offset to one side relative to the input shaft 22 of the pump 14. Because the grommets 38 may tend to deform slightly under such a lateral torque, even when the pump 14 is not operating, the holes 36 in the bracket 30 may be positioned to compensate for this grommet deformity so that the pump is level at rest. In the illustrative embodiment shown in FIG. 3, the holes 36 are offset about 1.2 degrees in a clockwise direction about the axis of the input shaft 22 of the pump 14 to compensate for the expected deformity in the grommets 38.

In some cases, one or more of the studs 34*a*-34*b* may include a hole or slot extending in a transverse direction across the stud 34*a*-34*b*. A safety pin 40 or other removable mechanical stop may extend through the hole or along the slot. This may help prevent the pump 14 from flying away from the motor 12 in the event that the input shaft 22 of the pump, the output shaft 20 of the motor 12 or the shaft connection should break or otherwise come loose during operation.

As detailed above, the set screw 24 may be used to loosen and/or tighten the coupling between the input shaft 22 of the pump 14 and the output shaft 20 of the motor 12. Thus, and in some illustrative embodiments, the pump 14 may be easily removed from the motor 12 by simply loosening the set screw 24, which loosens the coupling between the output shaft 20 of the motor 12 and the input shaft 22 of the pump 14. The pump 14 may then be pulled away from the motor 12 until the input shaft 22 of the pump 14 is disengaged from the output shaft 20 of the motor 12. When a bracket 30 is provided, such as shown in FIGS. 1-2, the pump 14 may be pulled sufficiently far away from the motor 12 so that the bracket 30 slides off the end of the studs 34*a*-34*b* and no longer provides any anti-rotational coupling between the pump 14 and the motor 12. When a safety pin 40 is provided, the safety pin 40 may first be removed, which may allow the bracket 30 to be slid off the end of the studs 34*a*-34*b*.

It has been found that by providing a direct coupling between the input shaft 22 of the pump 14 and the output shaft 20 of the motor 12, as well as a rotational stop mechanism with one or more resilient members interposed between the rotational stop mechanism and the pump and/or motor, the resulting pump assembly may produce relative low noise levels when operating.

Figure 3:
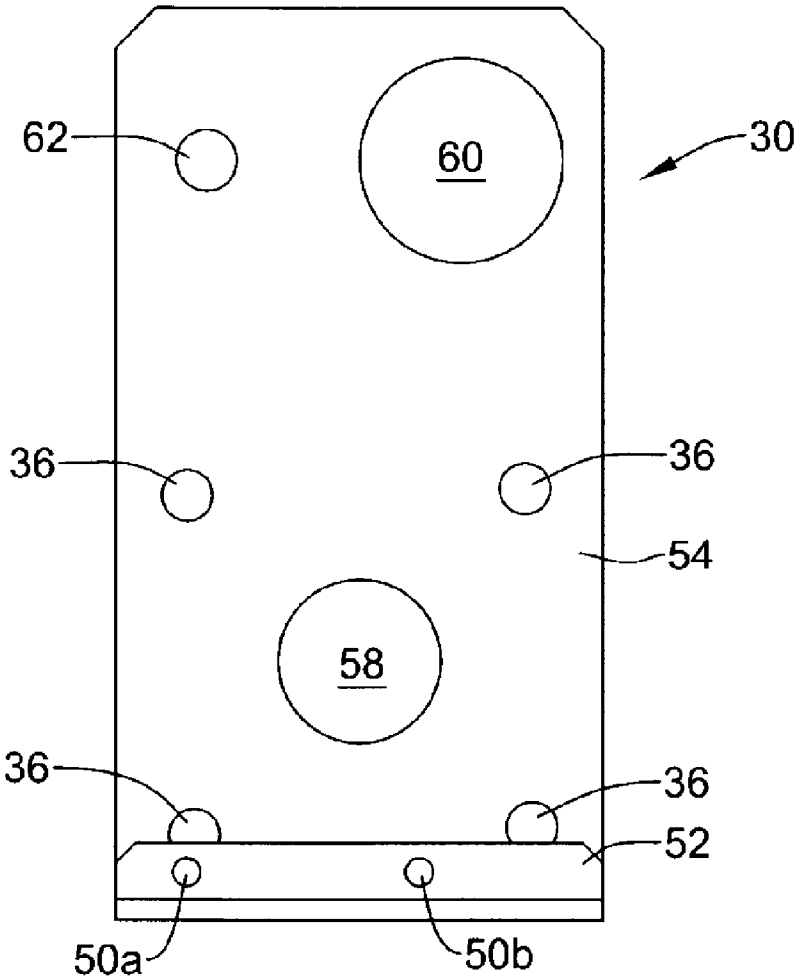
FIG. 3 is a front view of an illustrative rotational stop mechanism that may be used to help prevent the pump from freely rotating with the output shaft of the motor during operation.
Figure 4:
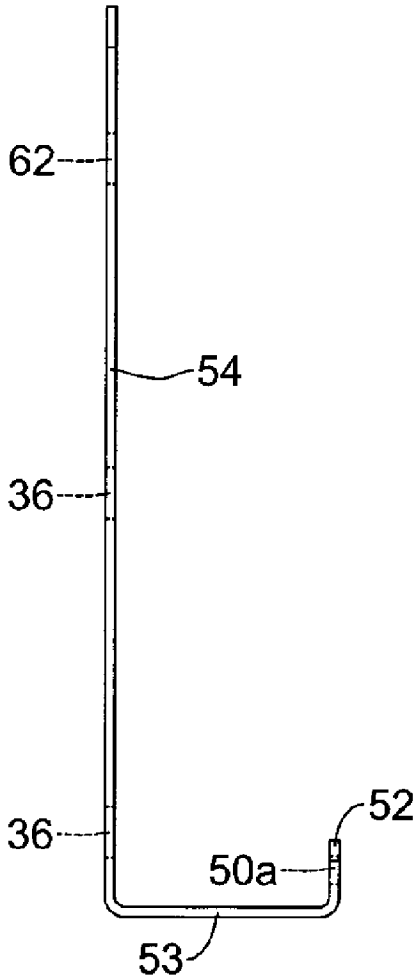
FIG. 4 is a side view of the illustrative rotational stop mechanism of FIG. 3.

FIG. 3 is a front view of an illustrative rotational stop mechanism that may be used to help prevent the pump from freely rotating with the output shaft of the motor during operation. FIG. 4 is a side view of the illustrative rotational stop mechanism of FIG. 3. The rotation stop mechanism shown in FIGS. 3-4 includes a bracket 30 that extends between the pump 14 and the motor 12. The illustrative bracket 30 may be bolted or otherwise secured to the housing of the pump 14, such as by bolt 32 (see FIG. 2). Bolt holes 50*a* and 50*b* may be provided in a first flange 52 of the bracket 30 to accept two such bolts 32. A second flange 54 may extend substantially parallel to the first flange 52, and may be connected to the first flange 52 by an intermediate leg portion 63, as best shown in FIG. 4. The second flange 52 may include a number of stud receiving holes 36 (four are shown), each for accepting a corresponding stud 34*a*-34*b*. The stud receiving holes 36 may be sized sufficiently large so that a grommet 38 or other resilient member may be placed in the hole and between the studs 34*a*-34*b* and the bracket 30.

The bracket 30 may also include a shaft receiving hole 58 for allowing the shaft of the pump 14 and/or the shaft of the motor 12 to pass through the bracket 30. In some embodiments, the bracket 30 may also include one or more accessory mounting holes, such as accessory mounting holes 60 and 62. Accessory mounting holes 60 and 62 may be adapted to accept and mount one or more accessories to the bracket 30, such as a pressure gauge, a valve or any other suitable accessory, as desired.

Figure 5:
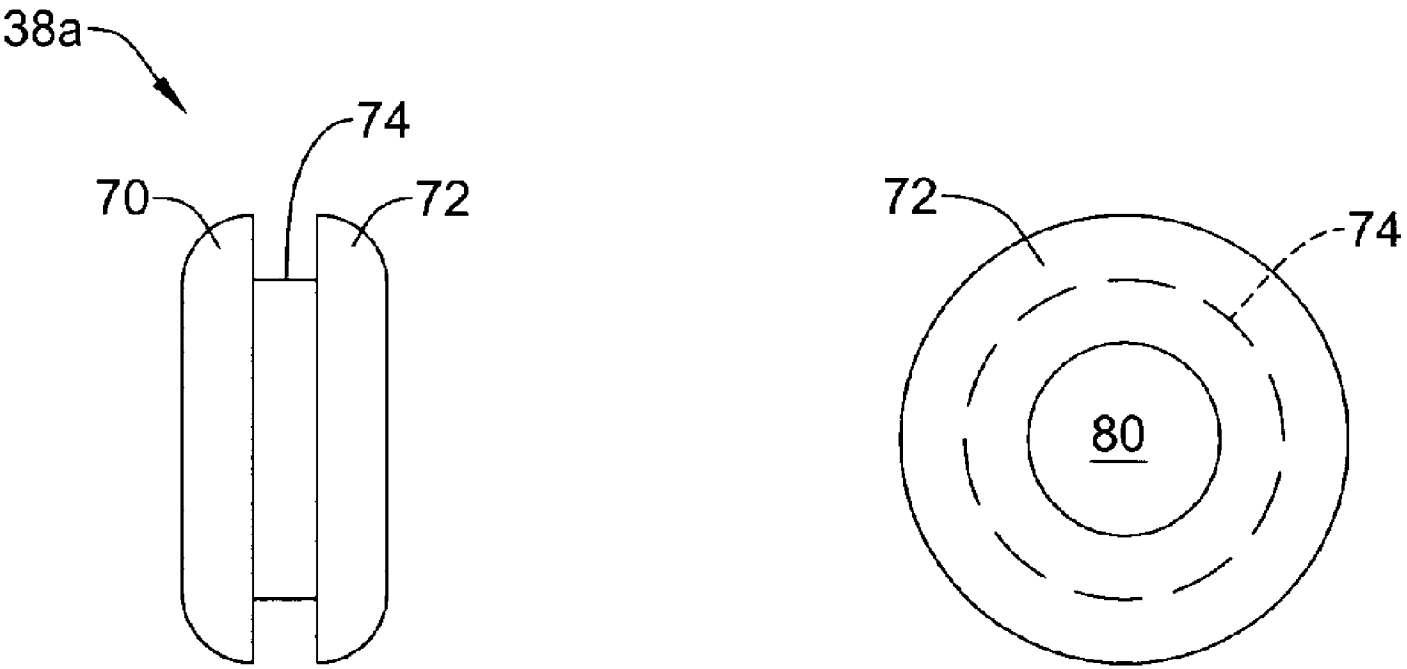
FIG. 5 includes a side view and front view of an illustrative resilient member that may be used to absorb or substantially absorb at least some of the relative movement between the pump and the motor.

FIG. 5 includes a side view and front view of an illustrative resilient member that may be used to absorb or substantially absorb at least some of the relative movement between the pump and the motor. In the illustrative embodiment, the resilient member is shown as a rubber grommet 38*a*. However, it is contemplated that any suitable resilient member may be used, and may be formed from any suitable material, as desired.

The illustrative grommet 38*a* includes a first side member 70 joined to second side member 72 by a reduced diameter central member 74. When installed, the reduced diameter central member 74 may be situated in one of the holes 36 of the bracket 30 (see, for example, FIG. 2), with the first side member 70 overlapping one side of the bracket 30 and the second side member 72 overlapping the opposite side of the bracket 30. The first side member 70 and the second side member 72 may tend to hold the grommet 38*a* in place. The illustrative grommet 38*a* includes a central hole or bore 80 that is adapted to receive a corresponding one of the studs 34*b*. The grommet 38*a* may absorb or substantially absorb at least some of the relative movement between the pump and the motor. It is contemplated that, in some embodiments, a grommet similar to that shown in FIG. 5 may be installed in each of the holes 36 of the bracket of FIG. 3.

Figure 6:
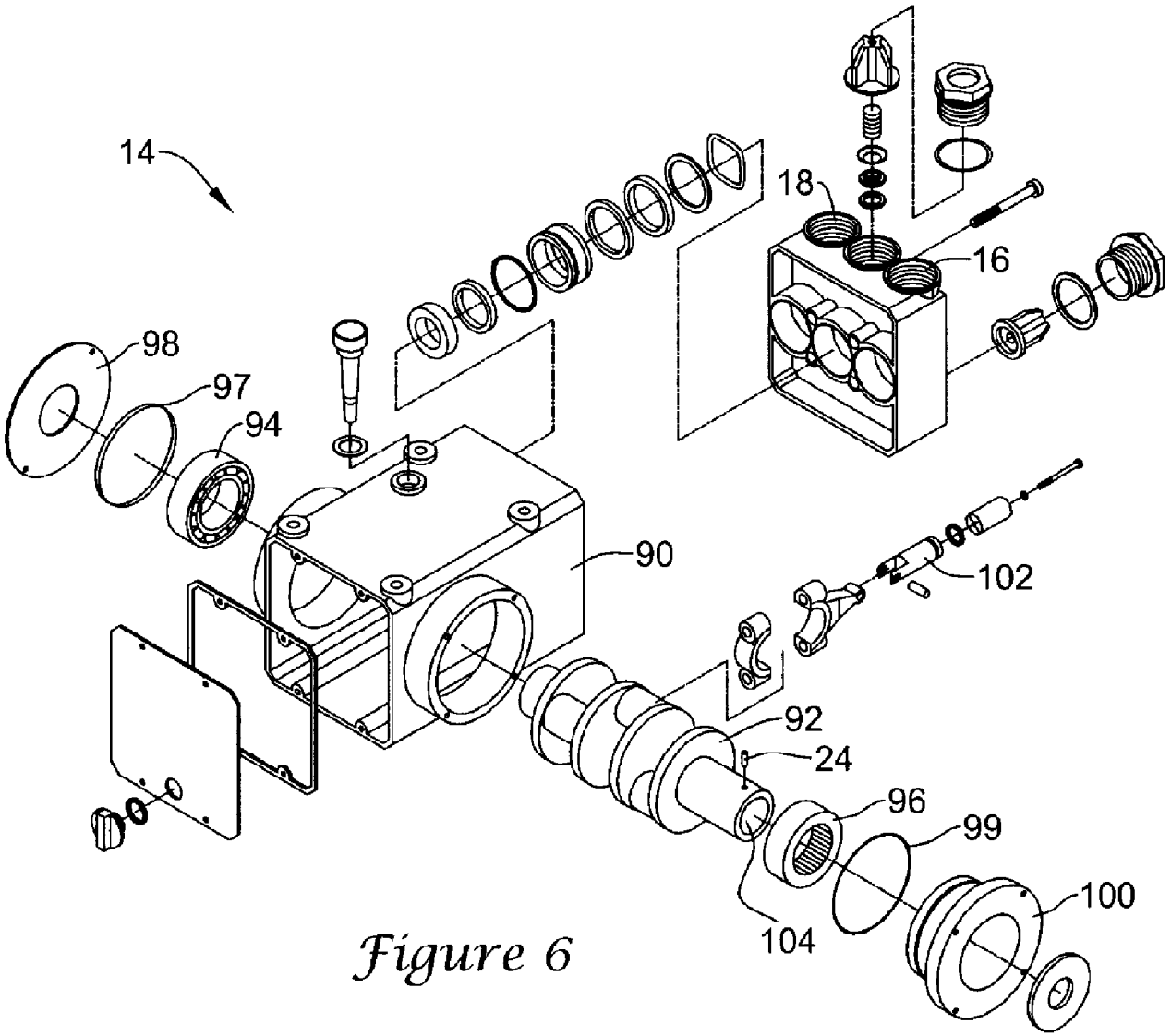
FIG. 6 is an assembly view of an illustrative piston pump that is suitable for use with the present invention.

FIG. 6 is an assembly view of an illustrative piston pump 14 that is suitable for use with the present invention. The pump shown in FIG. 6 is similar to a pump that is commercially available from Arimitsu of North America, located in Ramsey, Minn. However, the input drive shaft 92 shown in FIG. 6 has been modified to include a hollow shaft portion 93 that is adapted to receive an output shaft of a motor, as further described herein.

The illustrative piston pump includes a pump housing 90 that receives the input shaft 92. A first side bearing 94 and a second side bearing 96 are provided to support the input shaft 92 in the pump housing 90, and allow the input shaft 92 can freely rotate in the pump housing 90. A seal 97 and cover 98 provide protection and support to bearing 94. Likewise, a seal 99 and cover 100 provide protection and support to bearing 94.

The particular pump 14 shown in FIG. 6 includes three pistons, including a piston 102. The pistons are driven in a reciprocating fashion as the input shaft 92 is rotated, which produces a pumping action between the input port 16 and the output port 18. The housing 90 may be at least partially filled with oil or other lubricant during operation to help lubricate the various components therein. In some cases, it is desirable to keep the pump housing 90 fairly level during operation so that the oil or other lubricant can properly lubricate all of the desired components in the pump.

Figure 7:
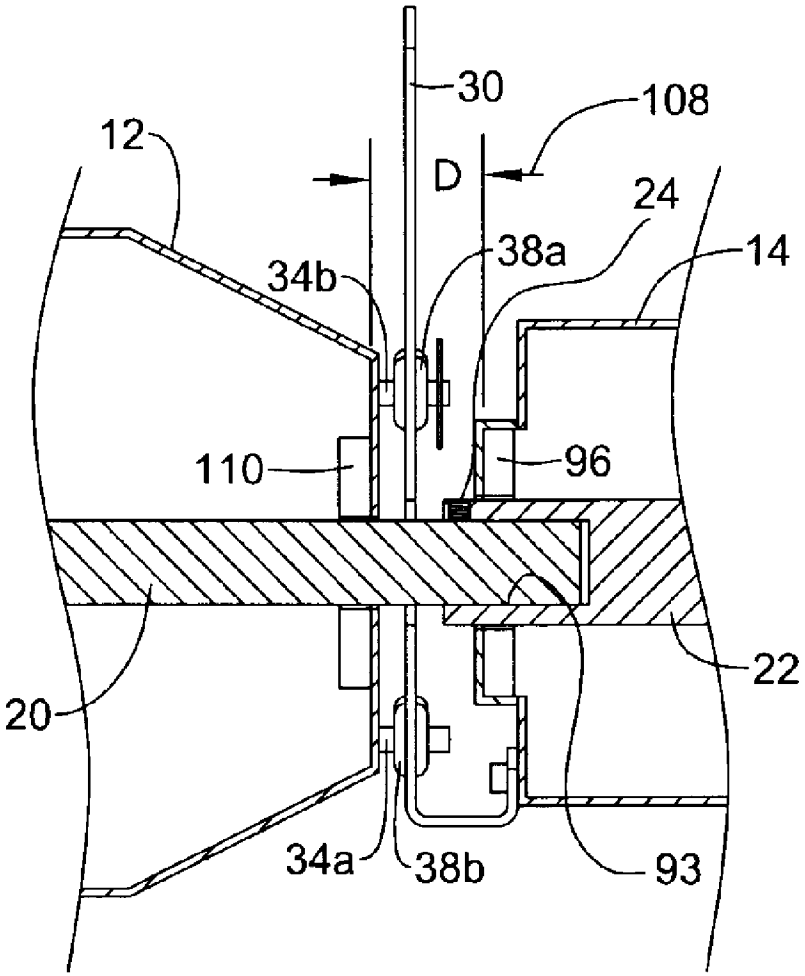
FIG. 7 is a partial cross-sectional side view of an illustrative connection between the motor output shaft and pump input shaft of FIG. 1.

FIG. 7 is a partial cross-sectional side view of an illustrative connection between the motor output shaft 20 and the pump input shaft 22 of FIG. 1. As can be seen, and in the illustrative embodiment, the pump input shaft 22 includes a hollow shaft portion 93 that extends from the end of the input shaft 22 for a distance. The hollow shaft portion 93 has an output shaft receiving lumen for receiving the output shaft 20 of the motor 12. The input shaft 22 of the pump 14 may have a key slot (not shown) that extends along at least part of the output shaft receiving lumen, and the output shaft 20 of the motor 12 may have a mating key member (not shown). Alternatively, or in addition, the input shaft 22 of the pump 14 may have a key member (not shown) along at least part of the output shaft receiving lumen, and the output shaft 20 of the motor 12 may have a mating key slot.

To help set or release the coupling between the input shaft 22 of the pump 14 and the output shaft 20 of the motor 12, and in some embodiments, a set screw 24 may extend through a side wall of the input shaft 22 and into the output shaft receiving lumen. The set screw 24 may engage the output shaft 20 of the motor 12, and when tightened, may secure the connection so that pump 14 is prevented from moving away from the motor 12, and visa-versa, during operation. Such a configuration may be called a "floating pump mount", because the pump 14 is primarily coupled to the motor 12 via the shaft connection. As a result of this connection, the output shaft 20 of the motor 12 may be naturally "aligned" with the input shaft 22 of the pump 14. There may be some relative movement between the pump 14 and motor 12 housings caused by shaft irregularities, but this relatively movement does not produce the same detrimental effects as a shaft misalignment.

To help reduce the downward torque on the drive shaft 20 of the motor 12 caused by the weight of the pump 14 in such a "floating mount configuration", it may be beneficial to reduce the distance "D" 108 between the pump 14 and the motor 12. In some embodiments, the output shaft 20 of the motor 12 may be supported by an output shaft bearing 110, and the input shaft 22 of the pump 14 may be supported by an input shaft bearing 96. In some embodiments, the direct connection between the output shaft 20 of the motor 12 and the input shaft 22 of the pump 14 may allow the spacing between the output shaft bearing 110 of the motor 12 and the input shaft bearing 96 of the pump 14 to be, for example, less than 2.0 inches, less than 1.0 inches, or less than 0.5 inches. By reducing the downward torque, the wear and tear on the output shaft bearing 110 of the motor 12 may be reduced.

When a set screw 24 is provided, the set screw 24 may be positioned in the space between the bearings 110 and 96, which in some cases, may allow the set screw 24 to be accessed and manipulated by the user of the pump assembly. As noted above, the set screw 24 may be used to loosen and/or tighten the coupling between the input shaft 22 of the pump 14 and the output shaft 20 of the motor 12.

Figure 8:
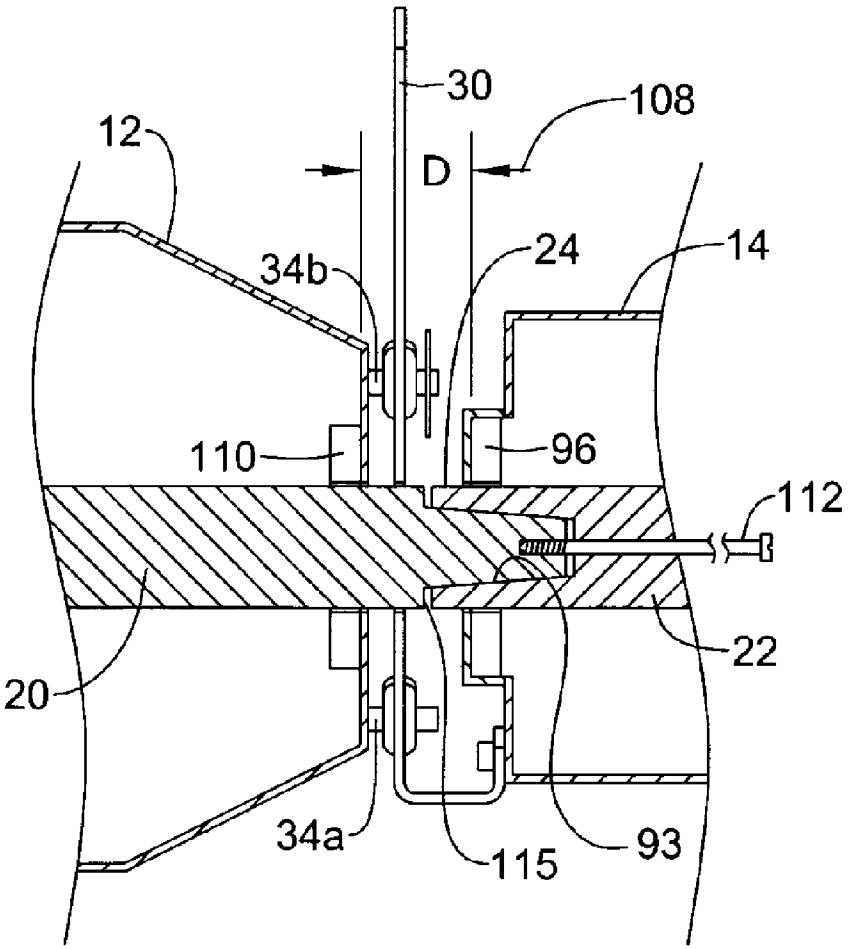
FIG. 8 is a partial cross-sectional side view of another illustrative connection between the motor output shaft and pump input shaft of FIG. 1.

FIG. 8 is a partial cross-sectional side view of another illustrative connection between the motor output shaft and pump input shaft of FIG. 1. This illustrative embodiment is similar that shown in FIG. 7, except that the hollow shaft portion 93 of the input shaft 22 of the pump 14 has a tapered diameter along its length. That is, the output shaft receiving lumen of the input shaft 22 of the pump 14 may have an inner dimension that decreases away from the end of the input shaft 22. In some cases, this may make it easier to remove the output shaft 20 of the motor 12 from the output shaft receiving lumen after securing mechanism therebetween is loosened.

In the illustrative embodiment, the securing mechanism between the output shaft 20 of the motor 12 and the input shaft 22 of the pump 14 includes a bolt 112. The bolt 112 extends down the center of the input shaft 22 of the pump 14 and is threaded into the distal end of the output shaft 20 of the motor 12. This may help secure the input shaft 22 of the pump 14 to the output shaft 22 of the motor 12. While a bolt 112 is shown in FIG. 8, it is contemplated that the input shaft 22 of the pump 14 may be selectively secured to the output shaft 22 of the motor 12 by any suitable securing mechanism, including the use of a set screw, as desired.

In some embodiments, and to further aid in the separation between the output shaft 20 of the motor 12 and the input shaft 22 of the pump 14, the output shaft 20 of the motor 12 may include a step 115 to a reduced diameter, which is spaced slightly from the end of the input shaft 22 of the pump 14 when the input shaft 22 of the pump 14 is fully engaged with the output shaft 22 of the motor 12. The space may be, for example, in the 1/16 to 1/4 inch range, but other spacing may also be used. Once the bolt 115 is removed, a screw driver or the like may be inserted into the space between the step 115 and the end of the input shaft 22 of the pump 14, and pivoted or struck with a hammer to help release the output shaft 20 of the motor 12 from the output shaft receiving lumen of the input shaft 22 of the pump. It is contemplated that the configuration of the input shaft of the pump and the output shaft of the motor as described above may be reversed. That is, and in some embodiments, the motor may include a tapered hollow shaft end, and the pump may include a tapered input shaft end along with a step that is spaced slightly from the end of the motor shaft when the pump shaft is fully engaged with the motor shaft, if desired.

Figure 9:
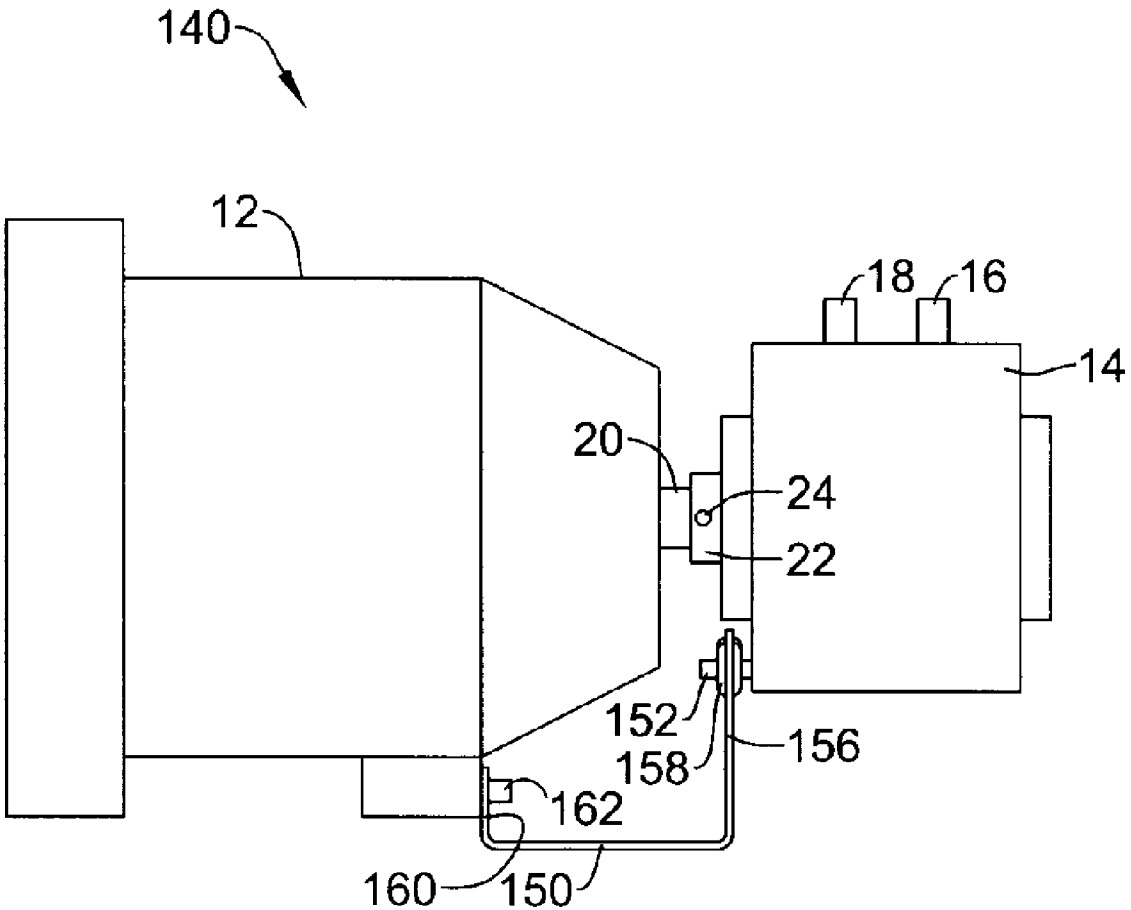
FIG. 9 is a schematic side view of a pump assembly in accordance with another illustrative embodiment of the present invention.

FIG. 9 is a schematic side view of a pump assembly 140 in accordance with another illustrative embodiment of the present invention. This illustrative embodiment is similar to that described above, except that the bracket 30 is replaced with a different bracket 150 configuration. A first flange 160 of bracket 150 is shown bolted to motor housing 12 by bolt 162. In some embodiments, the first flange 162 may be bolted or otherwise attached to the mounting feet of the motor 12, or any other suitable location. It is contemplated that rather than rigidly attaching the first flange 162 to the motor housing 12, a resilient member may be interposed between the first flange and the motor housing, if desired.

To help prevent the pump 14 from freely rotating with the output shaft 20 of the motor 12 during operation, a second flange 156 of bracket 150 may be coupled to the pump 14. In the illustrative embodiment, a post or stud 152 may extend from the pump housing 14. A hole may be provided in the second flange 156 that receives the post or stud 152. A resilient member, such as a grommet 158, may be positioned in the hole to absorb or substantially absorb at least some of the relative movement between the pump 14 and the motor 12.

Figure 10:
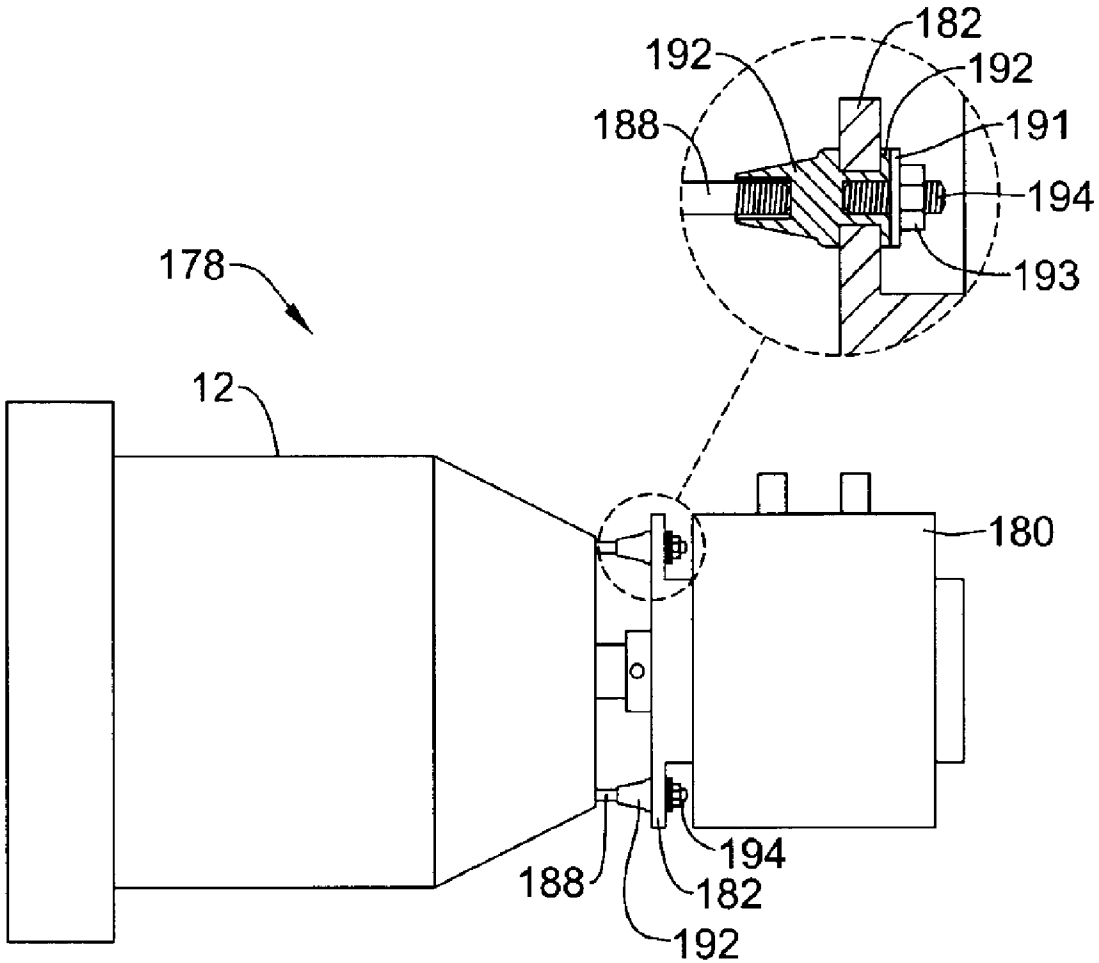
FIG. 10 is a schematic side view of a pump assembly in accordance with yet another illustrative embodiment of the present invention.

FIG. 10 is a schematic side view of a pump assembly 178 in accordance with yet another illustrative embodiment of the present invention. In this illustrative embodiment, a pump 180 includes a pump housing that has a bracket like portion 182. The bracket like portion 182 may be molded with the reminder of the pump housing, or may be separately formed and attached to the pump housing. In the illustrative embodiment, the bracket like portion 182 includes one or more holes. The one or more holes may be adapted to receive one or more studs from the motor housing 12, as well as a grommet or the like similar to that discussed above. For example, and as shown in FIG. 10, a threaded rubber grommet 192 may be used. The threaded rubber grommet 192 may include, for example, two metal threaded mounting holes, one on each side. A rubber plug, bobbin or other resilient member may be interposed therebetween. One of the threaded mounting holes may be threaded or otherwise attached to the end of a stud, such as stud 188, that extends from the motor 12. The other threaded mounting hole may be threaded or otherwise attached to a bolt 194 or the like that extends through one of the holes in bracket like portion 182. A nut 193 may then be tightened onto the bolt 194 to secure the connection. The threaded rubber grommet 192 may provide a resilient connection between each of the studs 188 and the pump housing.

Figure 11:
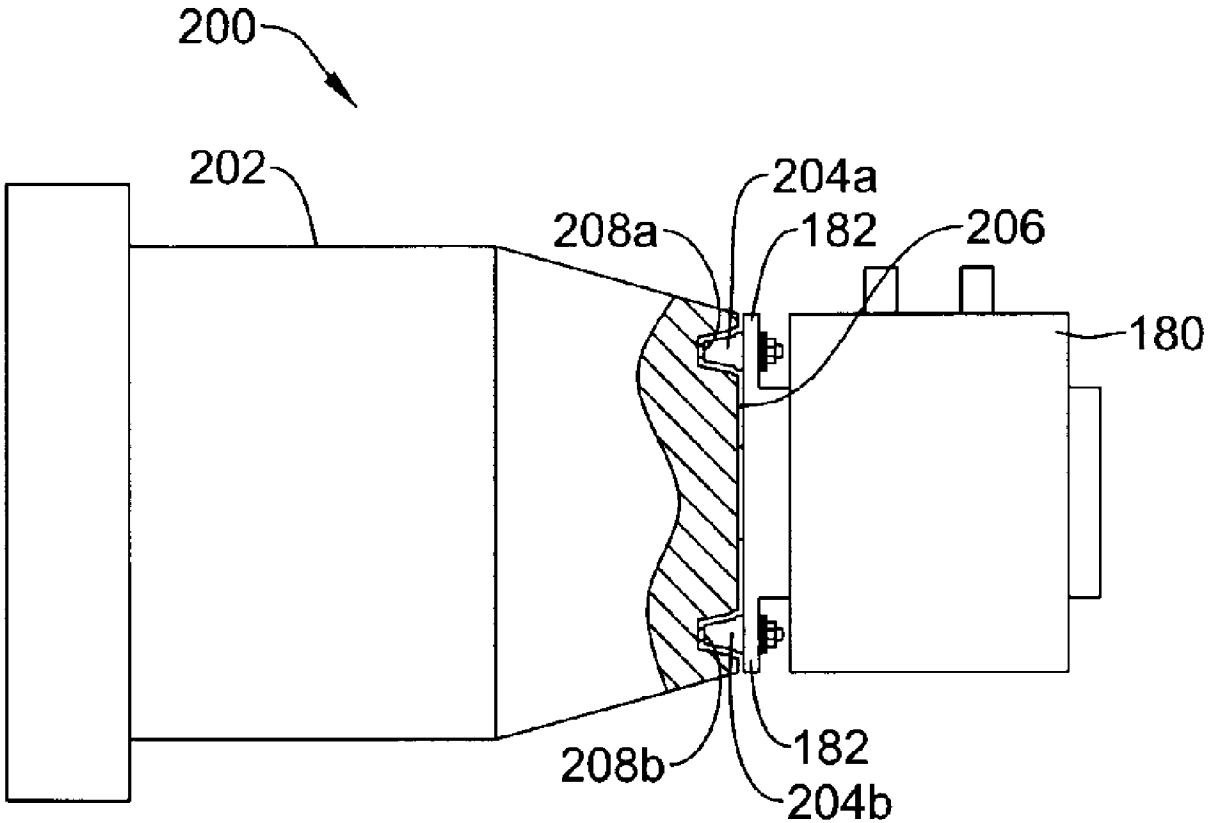
FIG. 11 is a schematic partial-cut away side view of a pump assembly in accordance with yet another illustrative embodiment of the present invention.

FIG. 11 is a schematic partial-cut away side view of a pump assembly 200 in accordance with yet another illustrative embodiment of the present invention. The pump 180 is similar to that shown and described above with respect to FIG. 10, and includes a pump housing with a bracket like portion 182.

The bracket like portion 182 includes one or more holes. In this illustrative embodiment, one or more resilient members, such as resilient members 204*a* and 204*b*, are secured to the bracket like portion 182 and extend away from the pump housing and toward the motor 202. The motor housing of the motor 202 has a front face 206 with depressions or recesses 208*a* and 208*b* that may match the shape and are adapted to receive the resilient members 204*a* and 204*b*. A space is provided between the motor housing and the bracket like portion 182 so that there is no direct contact therebetween (other than through the resilient members 204*a* and 204*b*). The resilient members 204*a* and 204*b* may provide a resilient connection between the motor 202 and the pump 180.

Figure 12:
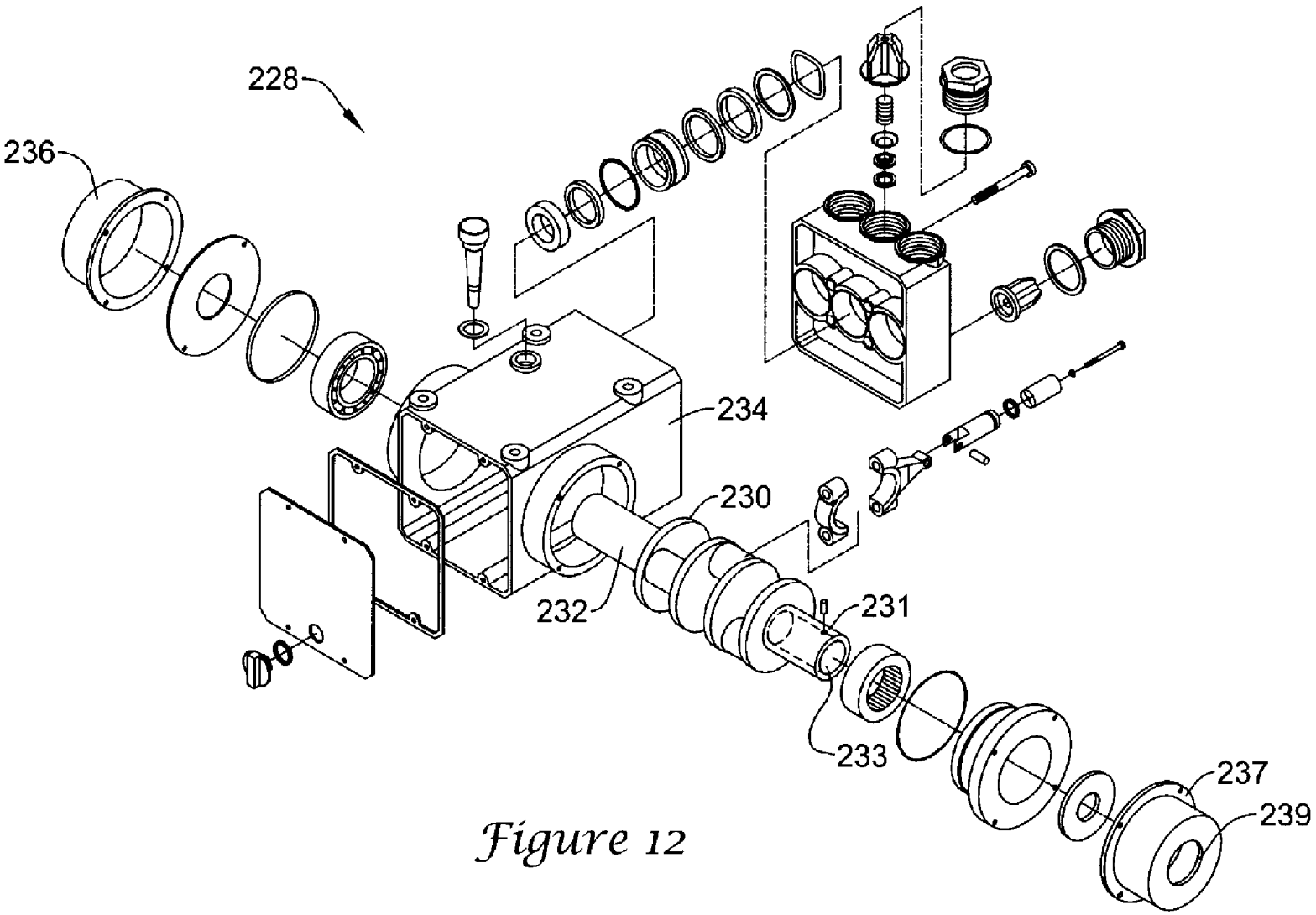
FIG. 12 is an assembly view of an illustrative piston pump that includes an input shaft that has a hollow shaft end and a solid shaft end extending out of the pump housing.

FIG. 12 is an assembly view of an illustrative piston pump 228 that includes an input shaft 230 that has a hollow shaft end 231 and a solid shaft end 232, each extending out of a respective end of the pump housing 234. In some cases, the input shaft 230 may have a hollow shaft end and both ends, if desired. In the illustrative embodiment of FIG. 12, the hollow shaft end 231 is adapted to receive an output shaft of a motor, as further described herein, and the solid shaft end 232 is not adapted to receive an output shaft of a motor, but rather is adapted to be selectively connected to a pulley, gear or other accessory. A cover 236 may be provided to cover either the solid shaft end 232 or the hollow shaft end 231, when either is not currently in use.

Such a configuration may allow the pump to be more easily adapted to different pump assembly configurations. For example, when a motor that includes a solid shaft is used to directly drive the pump 228, the output shaft of the motor may be received by a shaft receiving lumen 233 of the hollow shaft end 231, as described above. In those applications where the pump is to be driven by a pulley, gear or other accessory, a pulley, gear or other accessory may be mounted to the solid shaft end 232. The solid shaft end 232 may have one or more threaded holes or the like to aid in securing a pulley, gear or other accessory, but in the illustrative embodiment, it is not a "hollow" shaft in the sense that it is adapted to receive an output shaft of a motor. The cover 236 may be provided over whichever shaft end is currently not in use.

In some cases, a shaft cover such as shaft cover 237, may be provided over the shaft end that is currently in use. The shaft cover 237 may include a hole 239 through the housing to allow the shaft end 231 to extend therethrough. The shaft cover 237 may provide additional safety by helping to prevent a user from coming into contact with at least part of the spinning shaft end 231.

In some cases, the shaft 230 may be removed from the pump housing 234 and reversed in position, so that the hollow shaft end 231 extends out of the pump housing 234 in a leftward direction in FIG. 12, and the solid shaft end 232 extends out in a rightward direction. This may further increase the flexibility in mounting the pump 228 in different pump assembly configurations.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A pump assembly, comprising:

a motor having a housing and a rotating output shaft, the motor housing including a rod or bolt extending out in a parallel or substantially parallel relation to the output shaft, the rod or bolt including a transverse hole extending therethrough for receiving an optional safety mechanism;

a pump having a housing and a rotating input shaft, the rotating input shaft configured to transmit a rotational force to a pumping mechanism of the pump;

the input shaft of the pump being coupled to the output shaft of the motor, the coupling between the input shaft of the pump and the output shaft of the motor preventing the pump and the motor from moving away from each other during operation; and a rotational stop mechanism including a bracket for fixing the pump housing relative to the motor housing, the bracket configured to prevent the pump housing from freely rotating with the output shaft of the motor during operation, the rotational stop mechanism including at least one resilient member situated between the bracket and motor housing that engages the bracket for absorbing or substantially absorbing at least some relative movement between the pump and the motor as the output shaft is rotated by the motor, wherein the bracket includes a hole that slidingly engages the rod or bolt of the motor housing even during operation of the pump, wherein the resilient member is positioned in the hole between the bracket and the rod or bolt, wherein the at least some relative movement between the pump and the motor results from a misalignment of the input shaft of the pump and the output shaft of the motor at the coupling between the input shaft of the pump and the output shaft of the motor.

2. The pump assembly of claim 1 wherein the bracket is bolted to the pump housing.

3. The pump assembly of claim 1 wherein the bracket is an extension of the pump housing.

4. The pump assembly of claim 1 wherein the resilient member is a resilient grommet positioned in the hole between the bracket and the rod or bolt.

5. The pump assembly of claim 1 wherein the motor housing includes two or more rods or bolts extending out in a parallel or substantially parallel relation to the output shaft of the motor, and the bracket includes two or more holes that are positioned and configured to slidingly receive at least two of the two or more rods or bolts, and wherein a resilient member is positioned in at least selected holes between the bracket and the rods or bolts.

6. The pump assembly of claim 1 wherein the optional safety mechanism is a locking pin.

7. The pump assembly of claim 1 wherein the bracket further includes one or more holes that are configured to receive one or more accessories.

8. The pump assembly of claim 1 wherein the bracket further includes one or more accessories secured thereto.

9. The pump assembly of claim 8 wherein the one or more accessories includes a pressure gauge.

10. The pump assembly of claim 8 wherein the one or more accessories includes a valve.

11. The pump assembly of claim 1 wherein the coupling of the input shaft of the pump to the output shaft of the motor is without an intermediate structure.

12. The pump assembly of claim 1 wherein the bracket is secured relative to the pump housing and the motor housing such that there is no direct mechanical connection between the pump housing and the motor housing via the bracket other than through the at least one resilient members.

13. A pump assembly, comprising:

a motor having a housing and a rotating output shaft;

a pump having a housing and an input shaft that is coupled to the output shaft of the motor such that at least a portion of the output and input shafts overlap in a coaxial arrangement, creating a coupling, the coupling between the input shaft of the pump and the output shaft of the motor being the primary mechanism for preventing the pump and the motor from moving away from each other during operation;

a bracket coupling the pump housing and the motor housing for preventing the pump from freely rotating with the output shaft of the motor, wherein the bracket is securely coupled to one of the pump housing and the motor housing and is slidingly engaged with a protruding member extending from the other of the pump housing and the motor housing such that during operation, the slidingly engagement between the bracket and the protruding member does not significantly prevent the pump and motor from moving away from each other; and at least one resilient member that engages the bracket and is situated between the bracket and the motor housing and/or the bracket and the pump housing, the at least one resilient member absorbing or substantially absorbing at least some relative movement between the pump and the motor as the output shaft is rotated by the motor, wherein the at least some relative movement between the pump and the motor results from a misalignment of the input shaft of the pump and the output shaft of the motor at the coupling between the input shaft of the pump and the output shaft of the motor.

14. The pump assembly of claim 13 wherein the at least one resilient member is situated between the bracket and a protruding member of the motor housing.

15. The pump assembly of claim 14 wherein the protruding member including a transverse hole extending therethrough for receiving an optional safety pin, and the bracket includes a hole or opening for slidingly receiving the protruding member, and the at least one resilient member including a grommet positioned in the hole or opening of the bracket and around at least part of the protruding member of the motor housing.

16. The pump assembly of claim 15 wherein the protruding member is an elongated generally cylindrically shaped member.

17. The pump assembly of claim 13 wherein the at least one resilient member is situated between the bracket and a protruding member of the pump housing.

18. The pump assembly of claim 13 wherein the coupling of the input shaft of the pump to the output shaft of the motor is without an intermediate structure.

19. The pump assembly of claim 13 wherein the bracket is secured relative to the pump housing and the motor housing such that there is no direct mechanical connection between the pump housing and the motor housing via the bracket other than through the at least one resilient members.

* * * * *